US012297009B2

(12) United States Patent
Lenz et al.

(10) Patent No.: US 12,297,009 B2
(45) Date of Patent: May 13, 2025

(54) BOTTOM DISPENSING PACKAGE

(71) Applicant: Aptar Freyung GmbH, Freyung (DE)

(72) Inventors: Franz Lenz, Hinterschmiding (DE); Daniel Frey, Grainet (DE)

(73) Assignee: Aptar Freyung GmbH, Freyung (DE)

( * ) Notice: Subject to any disclaimer, the term of this patent is extended or adjusted under 35 U.S.C. 154(b) by 111 days.

(21) Appl. No.: 18/547,781

(22) PCT Filed: Mar. 2, 2021

(86) PCT No.: PCT/EP2021/025083

§ 371 (c)(1),
(2) Date: Aug. 24, 2023

(87) PCT Pub. No.: WO2022/184222

PCT Pub. Date: Sep. 9, 2022

(65) Prior Publication Data

US 2024/0140653 A1 May 2, 2024

(51) Int. Cl.
*B65D 35/46* (2006.01)
*B65D 47/08* (2006.01)
*B65D 47/20* (2006.01)

(52) U.S. Cl.
CPC ..... *B65D 35/46* (2013.01); *B65D 47/0838* (2013.01); *B65D 47/2031* (2013.01); *B65D 2251/20* (2013.01); *B65D 2401/00* (2020.05)

(58) Field of Classification Search
CPC ..... B65D 35/46; B65D 47/0838; B65D 47/2031; B65D 401/00; B65D 2401/25
See application file for complete search history.

(56) References Cited

U.S. PATENT DOCUMENTS 5,096,077 A * 3/1992 Odet ..... B65D 47/0838 215/320
5,386,918 A * 2/1995 Neveras ..... B65D 47/0838 215/254
5,392,938 A * 2/1995 Dubach ..... B65D 47/0814 220/254.5
5,702,033 A * 12/1997 Beaver ..... B65D 35/22 222/94

(Continued)

FOREIGN PATENT DOCUMENTS

WO 1980001061 A1 5/1980
WO 2007149149 A2 12/2007

OTHER PUBLICATIONS

Written opinion of the International Searching Authority for PCT/EP/2021/025083 of which this is a U.S. national phase application.

*Primary Examiner* — Ernesto A Grano
(74) *Attorney, Agent, or Firm* — Wood, Phillips, Katz, Clark & Mortimer

(57) ABSTRACT

The invention refers to a bottom dispensing package for a flowable composition, comprising a squeezable container for housing the flowable composition, a base element that is fixed to the container, whereby the base element comprises an orifice, whereby the orifice is placed in the direction of gravity beneath the container when the dispensing package is placed in its head-stand position on the base element, whereby the base element further comprises a closure connected to the base element and the closure can be moved back and forth between a closed position in which the closure closes the orifice and an open position in which the closure closes the orifice and an open position in which the composition can be released through the orifice.

10 Claims, 6 Drawing Sheets

(56) References Cited

U.S. PATENT DOCUMENTS 5,927,549 A * 7/1999 Wood ..... B65D 51/285 222/129
5,979,706 A * 11/1999 Grussmark ..... B65D 51/249 222/93
5,996,859 A * 12/1999 Beck ..... B65D 47/0809 215/237
6,053,375 A * 4/2000 Schwartz ..... B65D 41/18 215/28
6,971,531 B1 * 12/2005 Dubach ..... B65D 47/0861 220/827
7,731,042 B2 * 6/2010 Blomdahl ..... B65D 47/0809 220/254.5
8,777,030 B2 * 7/2014 Ziegenhorn ..... B65D 43/22 222/541.6
D716,142 S * 10/2014 Luijendijk ..... D9/449
9,546,027 B2 * 1/2017 Ziegenhorn ..... B65D 49/12
2003/0034323 A1 2/2003 Smith et al.
2004/0011829 A1 * 1/2004 Gaiser ..... B65D 47/0804 222/153.14
2010/0282705 A1 * 11/2010 Ledemeney ..... B65D 41/46 215/251
2013/0119079 A1 * 5/2013 Ziegenhorn ..... B65F 1/16 220/810
2014/0097150 A1 * 4/2014 Antier ..... B65D 43/0235 215/354
2015/0251817 A1 * 9/2015 Fox ..... B65D 41/02 222/555
2017/0036824 A1 2/2017 King
2020/0156829 A1 * 5/2020 Pristera ..... B65D 41/3428
2021/0107709 A1 * 4/2021 Garcia Alberola .... B65D 41/34

* cited by examiner

BOTTOM DISPENSING PACKAGE

FIELD OF THE INVENTION

The present invention relates to a bottom dispensing package for a flowable composition, comprising a squeezable container for housing the flowable composition, a base element that is fixed to the container, whereby the base element comprises an orifice with a slit-valve, which is especially configurated to prevent the composition to pass the slit-valve as long as container is not squeezed by an user, whereby the orifice is placed in the direction of gravity beneath the container when the dispensing package is placed in its head-stand position on the base element, whereby the base element further comprises a closure connected to the base element and the closure can be moved back and forth between a closed position in which the closure closes the orifice and an open position in which the composition can be released through the orifice, whereby the dispensing package further comprises at least one tamper evidence indication mean for especially visually indicating if the closure has once been moved out of its closed position and whereby the composition may contact the slit-valve when the closure has not been moved once out of its closed position.

BACKGROUND OF THE INVENTION

Bottom dispensing packages are well known in the prior art. There is a permanent desire for improving and controlling the oxygen and humidity intake from the outside of an according package to the inside of the package. A high and uncontrolled inbound transfer of oxygen and humidity may lead to a significant lower durability of the contained products inside the bottom dispensing package, as the oxygen and humidity may chemically and/or biologically interact with the contained product. Although it is known in the art to reduce the oxygen and humidity intake by increasing the material thickness of the dispensing package or certain material sections of the dispensing package, the conflicting demands of environmental and cost aspects require a low consumption of plastic materials.

Hence it is the objective of the present invention to optimise the oxygen and/or humidity barrier properties of a bottom dispensing package while not increasing the plastic material used in such a package.

BRIEF SUMMARY OF THE INVENTION

This problem is solved by a bottom dispensing package for a flowable composition, comprising a squeezable container for housing the flowable composition, a base element that is fixed to the container, whereby the base element comprises an orifice whereby the orifice is placed in the direction of gravity beneath the container when the dispensing package is placed in its head-stand position on the base element, whereby the base element further comprises a closure connected to the base element and the closure can be moved back and forth between a closed position in which the closure closes the orifice and an open position in which the composition can be released through the orifice, whereby—the base element has a circumferentially closed first contact surface with the container and/or the container has a circumferentially closed second contact surface with the base element, whereby the first contact surface and/or the second contact surface comprises a plurality of mainly parallelly arranged micro sealing lips which extend in orthogonal direction from the first contact surface of the base element and/or from the second contact surface of the container, whereby in a cross-sectional view the micro sealing lips having a tapering contour extending in the direction out of the contact surface whereby the micro sealing lips having a lip height>0.5 μm, preferably between 0.5-50 μm, whereby the micro sealing lips show a circumferential length which extend from 10%-100% over the circumferentially closed contact surface, and the circumferential length of the micro sealing lips is aligned between +−75-135° to the joining direction of the base element and the container whereby the circumferentially closed first contact surface and/or the second contact surface show(s) a micro sealing lip density>10, preferably between 50-500 micro sealing lips per $cm^2$ and the micro sealing lips comprise an E-Module<2000 MPa, preferably between 500-1500 MPa.

The interface between the container and the base element has a major impact on the oxygen and/or humidity barrier of such a dispensing package. The applicant has found through intensive research that the design of the contact surface at this interface has a major impact on the oxygen and/or humidity barrier of the bottom dispensing package.

It has been shown by the applicant that micro sealing lips present at the contact surfaces may significantly improve of the oxygen and/or humidity barrier into such a dispensing package.

It has further been shown by the applicant, that by configurating the contact surfaces within the claimed parameter intervals, the oxygen and humidity barrier of the dispensing package can be significantly improved without using more plastic material.

Furthermore, the oxygen and humidity barrier properties of the inventive dispensing package are improved in a way that an additional aluminium coated liner closing the container opening is not necessary to ensure a low oxygen and/or humidity transfer into the container. With the configuration claimed by the inventive dispensing package, the use of a so far necessary aluminium coated liner, which has to be removed by a user prior to the first use of the dispensing package, becomes obsolete. Therefore, in a most preferred embodiment of the invention, the container is not sealed by a removable liner element.

Hence, the user can dispense a flowable composition from the dispensing package directly after the first opening of the closure without the necessity of additionally removing the aluminium coated liner form the squeezable container. Beside of the enhanced user convenience of the claimed dispensing package, its more environmentally friendly as it avoids the use of a throw-away article such as the aluminium coated liner. As aluminium is also associated with triggering Alzheimer-disease and other diseases, the claimed dispensing package is also acceptable for health sensitive users.

A container according to this invention is any receptacle or enclosure for holding a product used in storage, packaging, and shipping. Flowable materials kept inside of a container are protected by being inside of its structure. A container according to this invention can be especially selected from the group of bottles, particularly plastic bottles, cans or bags. The container can be pressurised or non-pressurised in its initially closed state.

A flowable material according to this invention may be selected from the group of fluids, gels, pastes, gases, granular solids in particulate form or mixtures thereof.

Further improvements may be achieved in that the relative contact surface between the base element and the container is >10 $mm^2$. The relative contact surface is calculated as the contact surface between the base element and the container divided by the surface of the container. It is further preferred that the relative contact surface between the base element and the container has a cylindrical shape. It is additionally preferred that the relative contact surface between the base element so and the container is provided at the orifice of the base element.

It could be proven by the applicant that according to a further preferred embodiment of the invention, the base element is fixed onto the container so that the surface contact pressure between the first contact surface of the base element and the second contact surface of the container is >1 $kp/cm^2$. Here the micro sealing lips show a beneficial sealing behaviour against an unintended oxygen and humidity transfer through the interface between the base element and the container.

The closure of the dispensing package may be actuated by turning, screwing, twisting, pulling, pushing, pivoting or a combination thereof relative to the base element. It is especially preferred that the closure is a lid, that is connected to the base element by a hinge so that the lid is pivotably moved between a closed and an open position. The bottom dispensing package may further comprise at least one tamper evidence indication means for especially visually indicating if the closure has once been moved out of its closed position. In this context it is especially preferred that the composition may contact the slit-valve when the closure has not been moved once out of its closed position.

The base element including the orifice and the closure, and/or the container is preferably made of a plastic material. It is further highly preferred that the base element, including the orifice and the closure, and/or the container is made from PET. It is also well preferred that the base element, including the orifice and the closure, and/or the container is made of the same plastic material, especially preferred the same PET material.

It may also be preferred to make the base element from a PP or HDPE and the container from a PET, HDPE or PP.

To further improve the oxygen barrier properties and the dispensing experience of a user of the bottom dispensing package, the base element further comprises a slit-valve, which is especially configurated to prevent the composition to pass the slit-valve as long as container is not squeezed by a user. According to another preferred embodiment of the invention the slit-valve is made from elastomeric material, especially from a TPE, silicon or PU. According to another preferred embodiment, the slit-valve is having a cross-shaped slit. The slit-valve may be fixed to the orifice according to a yet also preferred embodiment of the invention.

In yet another highly preferred embodiment of the bottom dispensing package, the flowable composition has a viscosity between 4-9, preferable between 5-7.5. The viscosity of the flowable composition can be measured with a Bostwick™ Consistometer according to ASTM F1080-93. It has been shown that such a flowable composition may be drawn between the micro sealing lips of the contact surface between the container and the base element by capillary forces. As the flowable material is hold back in the micro-channels by these capillary forces, it cannot flow back into the container whereby the flowable material seals the micro-channels. Hence, the flowable composition in combination with the contact surface between the container and the base element can further improve the oxygen and humidity barrier properties of the dispensing package.

In this context it is especially preferred that the flowable composition has a ReDox-Potential Eh of +200 to +600 mV at pH7, so that the flowable composition serves as buffering solution against oxygen intake. As the flowable material is hold back between the micro sealing lips, oxygen that migrates between the micro sealing lips reacts with the flowable composition, through which the oxygen intake into the container can be decelerated.

Another measure to improve the oxygen and humidity barrier of the dispensing package is that the contact surfaces are at least partially, preferably completely covered by a plasma-coating.

The micro sealing lips can be realised e.g. by additive manufacturing processes by which the according micro sealing lips can be realised as a negative form in an injection mould tool. Hence, in one preferred method to manufacture the base element and/or the container, the injection moulding tool is formed by means of an additive manufacturing process.

Using an additive process offers the particular advantage that the injection moulding tool can be produced as a whole, in particular monolithically, in a simple manufacturing step. An additive manufacturing process is often also referred to as a generative manufacturing process or a three-dimensional printing process (3D printing). The additive manufacturing process enables the injection moulding tool to be manufactured quickly and cost-effectively in one work process, whereby the manufacturing can be carried out in particular on the basis of computer-internal data models from shapeless or shape-neutral starting material by means of chemical and/or physical processes.

In connection with the present invention, an additive manufacturing process results in the possibility of combining a high-performance material with the generation of an unusual but defined contact surface of the base element and/or the container to improve the oxygen and/or humidity barrier characteristics of the interface base element—container.

In this context, an additive or generative process can be understood in particular as a process in which a component is built up layer by layer on the basis of digital 3D design data by depositing or building up material. Examples of such processes include 3D printing, which is often also understood to mean laser sintering or laser melting. An additive manufacturing process differs significantly from conventional, ablative manufacturing methods. Instead of milling a workpiece from a solid block, for example, as is known from ablative processes, the components in additive manufacturing processes are built up layer by layer from materials or raw materials that are available as starting material, in particular as fine powder. Such processes are used, for example, in rapid prototyping or in series production.

In most cases, a laser, such as a CO2 laser, an Nd:YAG laser or a fiber laser, or an electron beam source is used for processing, for example for melting the raw material, which is in particular in powder form.

In this way, additive manufacturing processes can be used to produce an injection moulding tool having a negative surface for producing a contact surface of the base element and/or a contact surface of the container forming a bottom dispensing package comprising micro sealing lips.

Another possibility to realise the micro sealing lips is by mechanically controlled honing or manual polishing the injection moulding tool. Manual polishing may be realised with a diamond polishing paste with a grain size of 1 μm and a rotation speed of the polishing tool between 800-1200 $min^{-1}$. The polishing direction is defined by the intended direction of the micro sealing lips.

BRIEF DESCRIPTION OF THE DRAWINGS

In the following, the invention will be explained in more detail on the basis of figures without limiting the general concept of the invention.

DETAILED DESCRIPTION OF THE PREFERRED EMBODIMENTS

Figure 1:
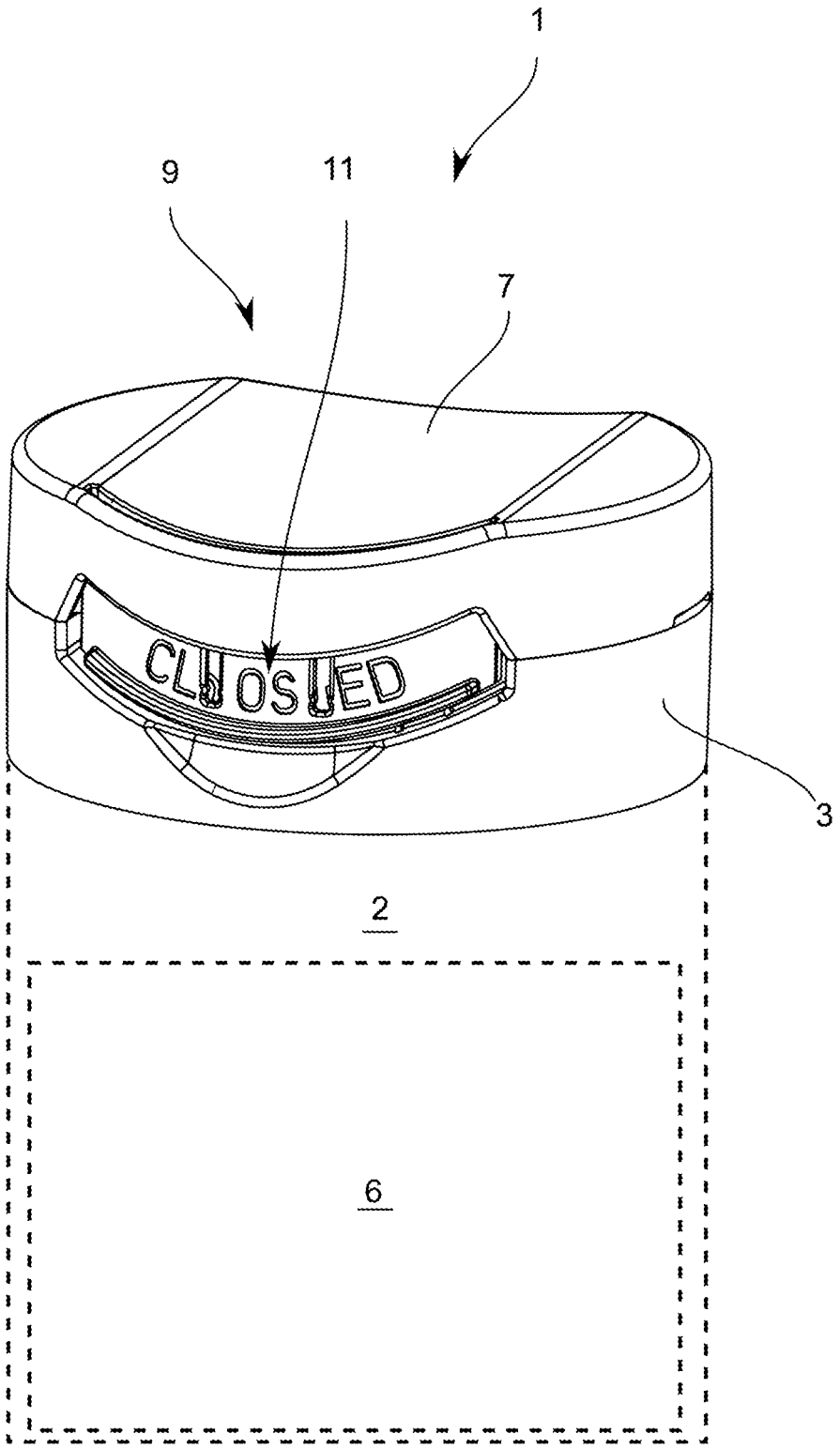
FIG. 1 a bottom dispensing package in a perspective view.

FIG. 1 shows a bottom dispensing package 1 for a flowable composition 6. The dispensing package comprises a squeezable container 2 for housing the flowable composition 6 and a base element 3 that is fixed to the container 2. The base element 3 further comprises a closure 7 connected to the base element 3 which can be moved back and forth between a closed position 9 in which the closure 7 closes the orifice 4 and an open position 10 in which the composition 6 can be released through the orifice 4. The orifice 4 is placed in the direction of gravity beneath the container 2 when the dispensing package 1 is placed in its head-stand position on the base element 3. In FIG. 1, the closure 7 is shown in its closed position 9.

Figure 2:
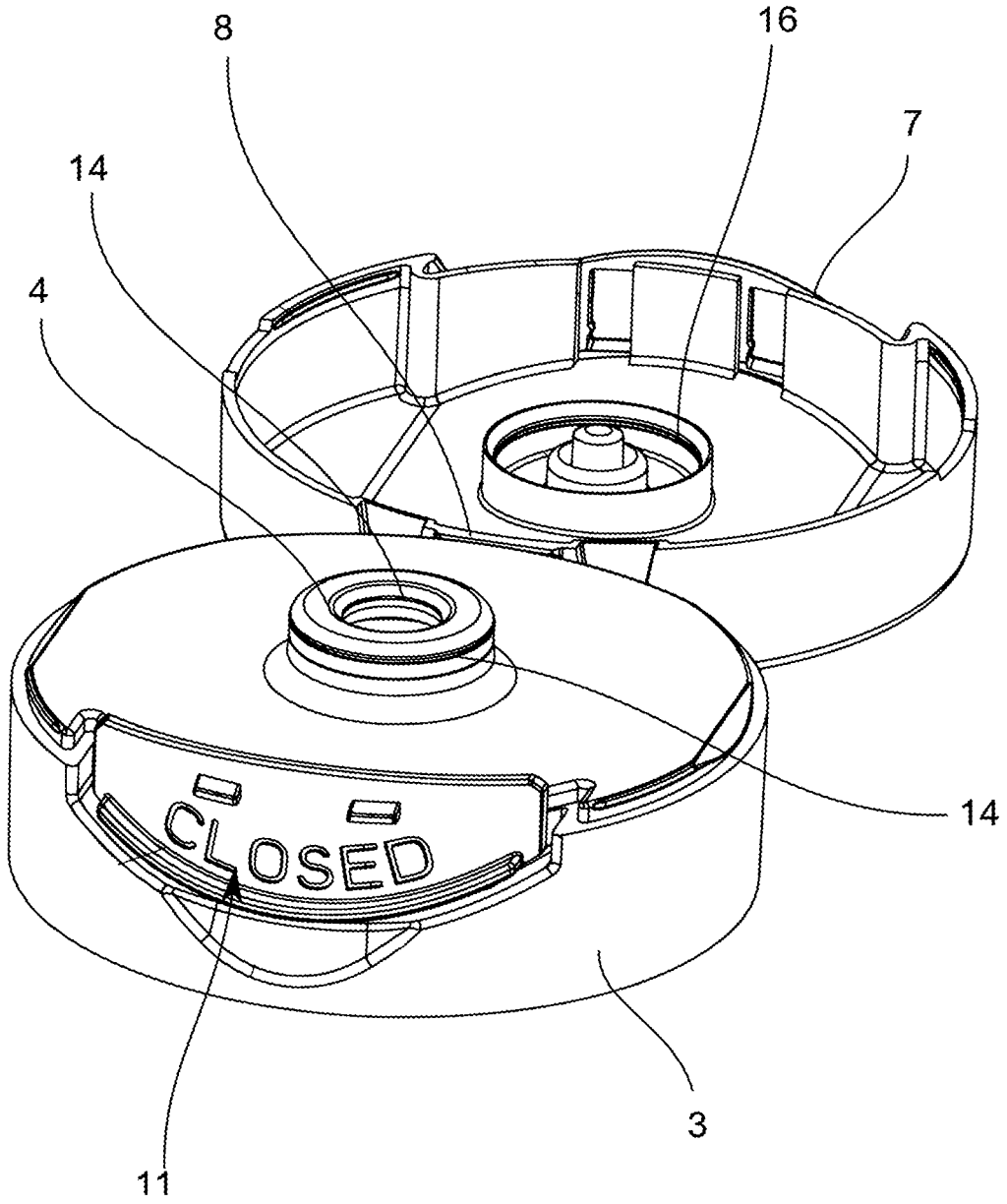
FIG. 2 a base element with an opened closure in a perspective view.

FIG. 2 shows the closure 7 in its open position. In the shown examples the closure 7 is a lid, that is connected to the base element 3 by a hinge 8. As it can be seen from FIG. 2, the base element 3 comprises a cylindrical orifice 4, which extends from the base element 3 in an axial direction away from the container 2.

The dispensing package 1 further comprises at least one tamper evidence indication mean 11 for especially visually indicating if the closure 7 has once been moved out of its closed position 9. The tamper evidence indication means 11 ensures a tight and defined closure of the closure 7 prior to the first use of the dispensing package by a user. The closure 7 is fixed onto a contact surface 14 of the base element, at least as long the closure has not been opened by a user.

Corresponding to the cylindrical shape of the orifice 4, the closure 7 has a cylindrical closure element 16, whereby the inner shell surface of the closure element 16 contacts the outer shell contact surface 14 of the orifice 4.

Figure 3:
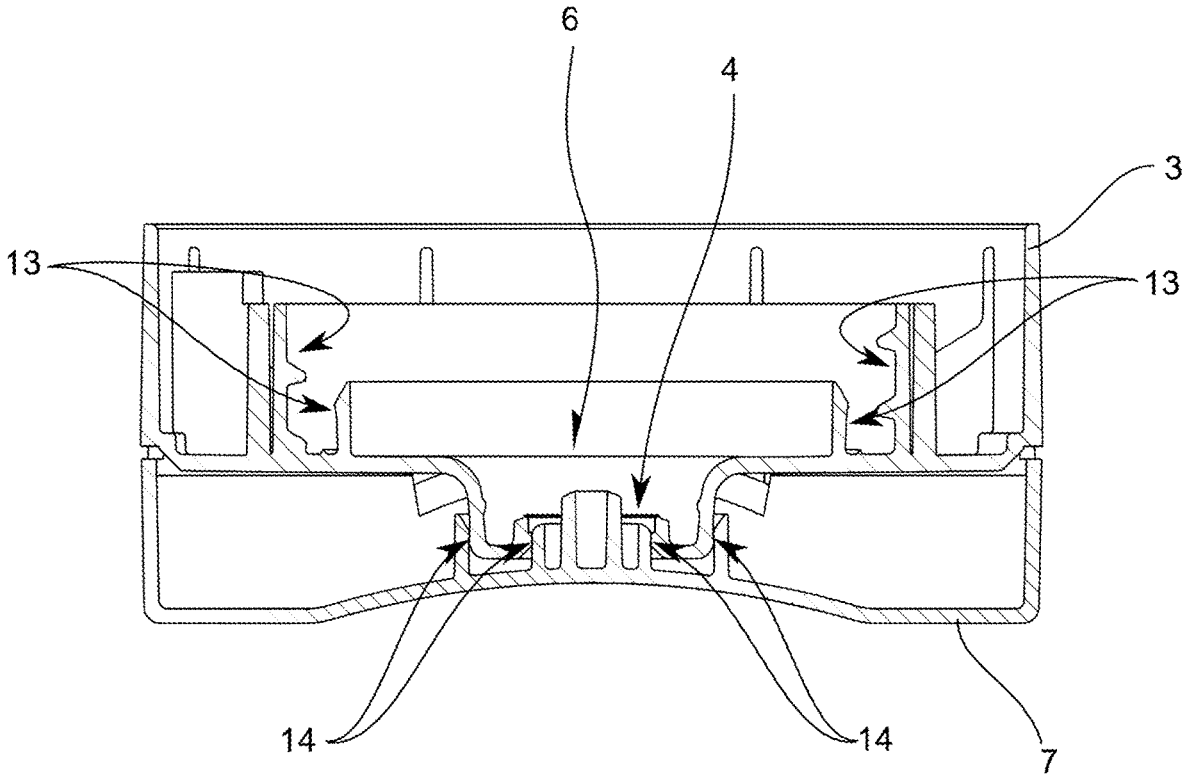
FIG. 3 a base element with a closed closure in a cross-sectional view.
Figure 4:
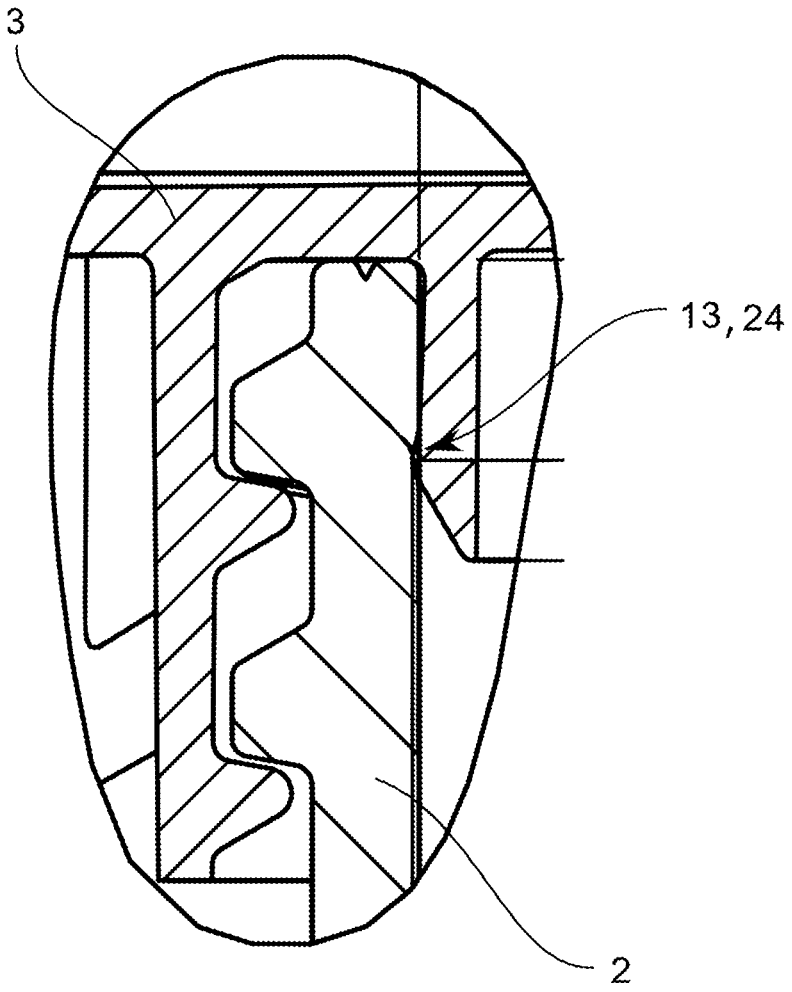
FIG. 4 a cross-sectional detailed view if the connection between the container and the base element, FIG. 5 schematic cross-sectional sketches of the micro sealing lips, and FIG. 6 schematic views on different micro sealing lip configurations.

The base element 3 is fixed onto a contact surface 13 of the container 2, which can be seen from a joint view on FIG. 3 and FIG. 4. This interface between the base element 3 and the container 2 has a significant impact on the oxygen and humidity transfer from the outside into the container 2.

The base element 3, including the orifice 4 and the closure 7 is made from PET.

The base element 3 has a circumferentially closed first contact surface 13 with the container 2, and the container 2 has a circumferentially closed second contact surface 24 with the base element 3.

Figure 5:
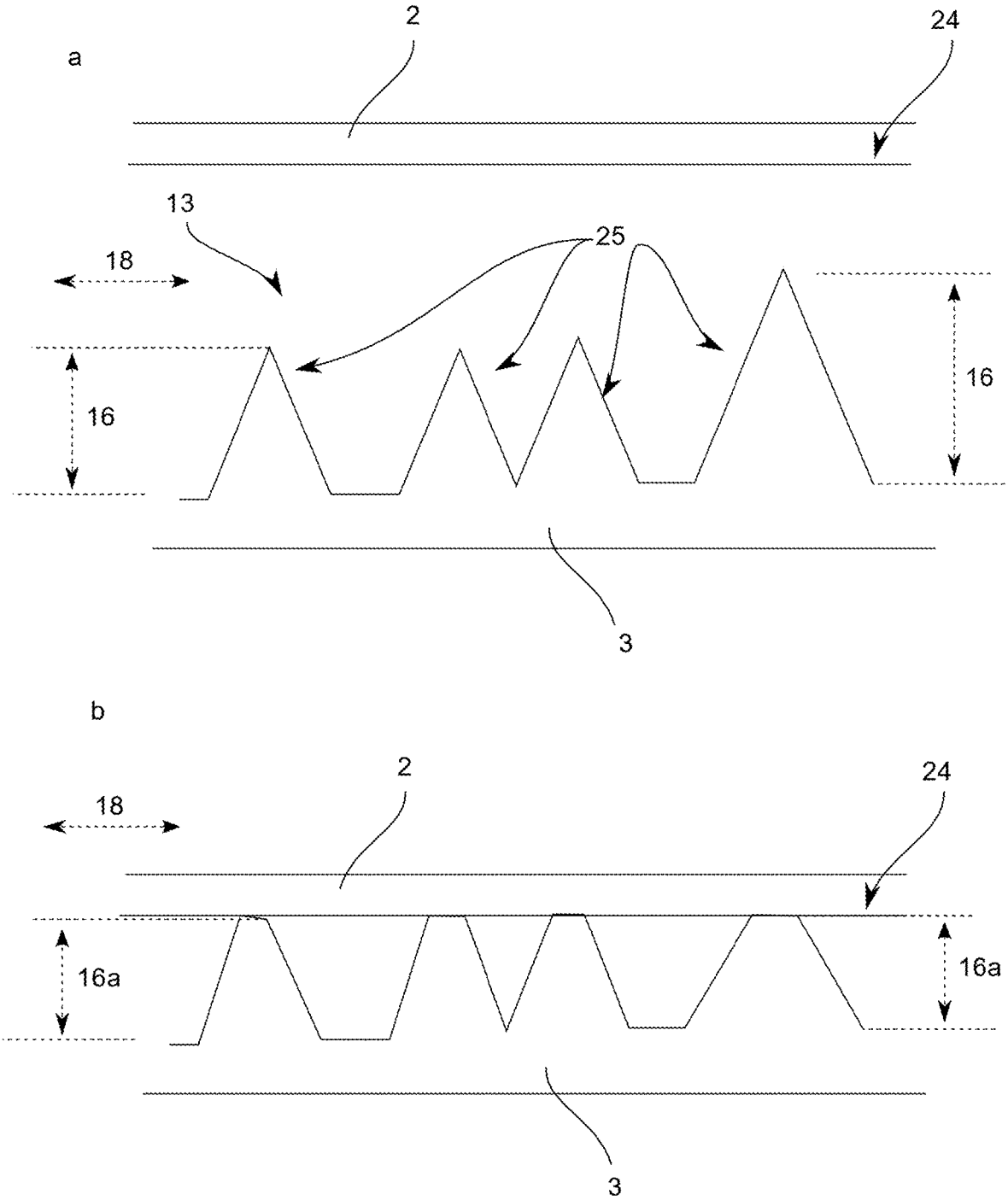

In the shown embodiment of FIGS. 3-5 the first contact surface 13 comprises a plurality of mainly parallelly arranged micro sealing lips 25 which extend in orthogonal direction from the first contact surface 13 of the base element as it is shown in FIG. 5. In this cross-sectional view the micro sealing lips 25 having a tapering contour extending in the direction out of the first contact surface 13.

The micro sealing lips 25 having a lip height 16 between 0.5-50 μm. As it is indicated in FIG. 5, not all micro sealing lips 25 have the same lip height 16 due to according tolerances in the manufacturing process. Also, the distance between the micro sealing lips 25 may vary due to this reason.

Due to the tapering contour of the micro sealing lips 25 the micro sealing lips 15 are elastically and/or plastically deformed against the contact surface 14, thereby realising multiple of linear seal sections between the first contact surface 13 of the base element 3 and the second contact surface 14 of the container 2. This is shown in illustration b (bottom) of FIG. 5. As it can be seen from FIG. 5, the initial lip height 16 of the micro sealing lips 15 is reduced (16*a*) due to the pressure build up and pressure maintenance between the base element 3 and the container 2 when the base element 3 is assembled on the container 2. It has been proven to be beneficial for this elastically and/or plastically deformation that the micro sealing lips 25 comprise an E-module between 500-1500 MPa.

Figure 6:
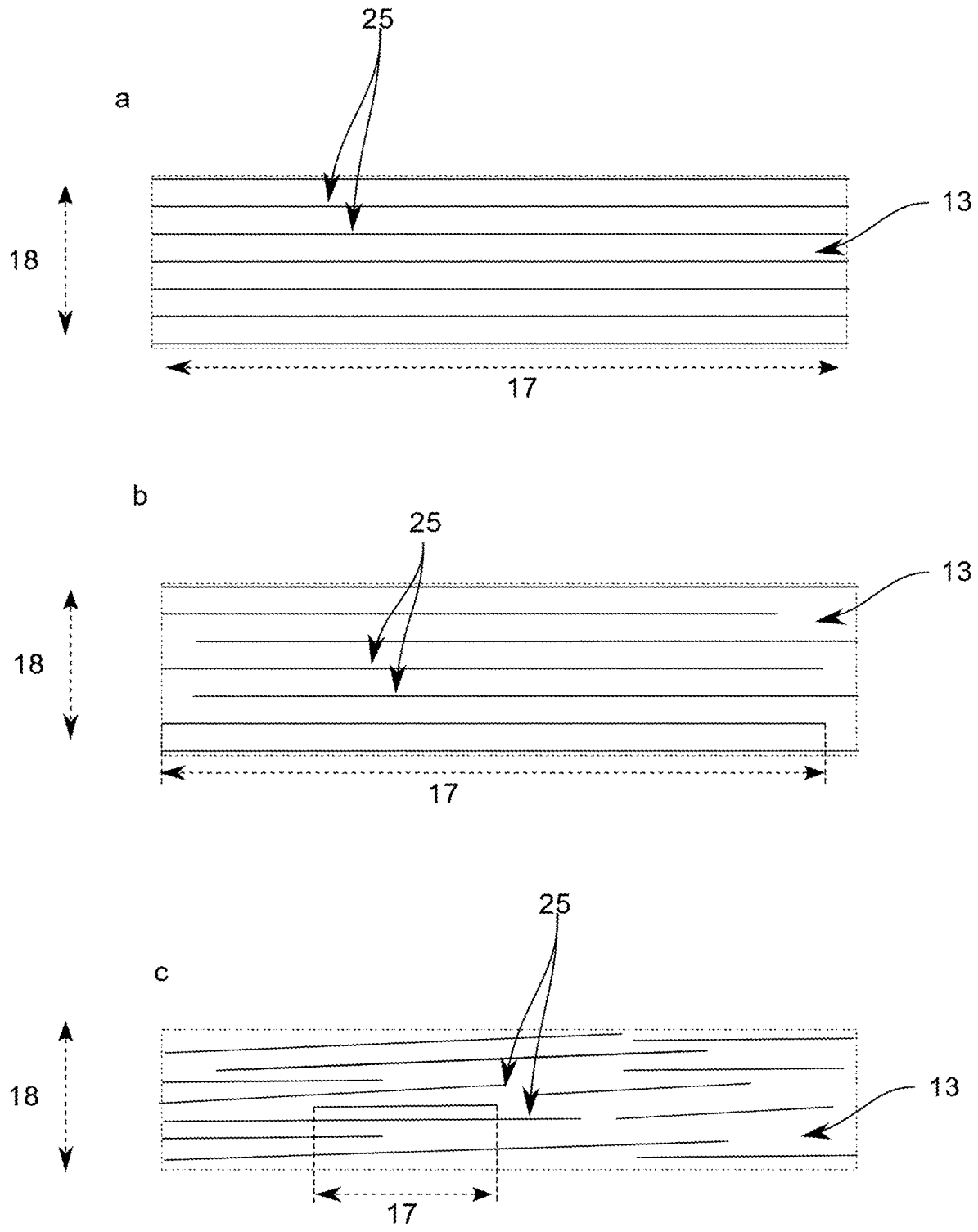

FIG. 6 shows different possible configurations of the micro sealing lips 15 and their circumferential layout. In general, the micro sealing lips 25 show a circumferential length 17 which extend from 10%-100% over the circumferentially closed first contact surface 13 and/or second contact surface 24.

In the illustration a of FIG. 6 a configuration is shown in which all micro sealing lips 15 have a circumferential length 17 which extend to 100% over the circumferentially closed first contact surface 13. In other words, each micro sealing lip 15 forms a closed ring.

In the illustration b a configuration is shown in which the sealing lips 15 do not form closed rings as in the embodiment of illustration a. Their circumferential length 17 does not extend to 100% over the circumferentially closed first contact surface 13. Hence, the micro sealing lips 15 form a labyrinth with a path via that the flowable composition 6 can enter the labyrinth, e.g. by capillary forces.

In the illustration c a configuration of micro sealing lips 25 is shown, in which the circumferential length of the micro sealing lips 25 is aligned between +−75-135° to the joining direction 18 of the base element 3 and the container 2. In this configuration the micro sealing lips 25 are not oriented strictly parallel to each other what can be easily derived from FIG. 6*c*. Surprisingly, this configuration also shows excellent oxygen and/or humidity barrier characteristics and is more tolerant regarding manufacturing tolerances forming the micro sealing lips 25.

The circumferentially closed first contact surface 13 shows a micro sealing lip density between 50-500 micro sealing lips 25 per $cm^2$.

The invention is not limited to the embodiments shown in the figures. The above description is therefore not to be regarded as restrictive, but as explanatory. The following patent claims are to be understood in such a way that a named feature is present in at least one form of implementation of the invention. This does not exclude the presence of further features. If the patent claims and the above description define 'first' and 'second' features, this indication serves to distinguish two features of the same kind without establishing an order of priority.

REFERENCES

1 bottom dispensing package
2 container
3 base element
4 orifice
5 slit-valve
6 flowable composition

7 closure
8 hinge
9 closed position
10 open position
11 tamper evidence indication mean
13 contact surface
14 contact surface
15 contact surface
16 closure element
17 circumferential length
18 joining direction
24 contact surface
25 micro sealing lip

The invention claimed is:

1. A bottom dispensing package for a flowable composition, comprising a squeezable container for housing the flowable composition, a base element that is fixed to the container, whereby the base element comprises an orifice whereby the orifice is placed in the direction of gravity beneath the container when the dispensing package is placed in its head-stand position on the base element, whereby the base element further comprises a closure connected to the base element and the closure can be moved back and forth between a closed position in which the closure closes the orifice and an open position in which the composition can be released through the orifice, characterised in that the base element has a circumferentially closed first contact surface with the container, and/or the container has a circumferentially closed second contact surface with the base element, whereby the first contact surface and/or the second contact surface comprises a plurality of mainly parallelly arranged micro sealing lips which extend in orthogonal direction from the first contact surface of the base element and/or from the second contact surface of the container, whereby in a cross-sectional view the micro sealing lips have a tapering contour extending in the direction out of the contact surface, whereby the micro sealing lips have a lip height greater than 0.5 μm, and the micro sealing lips show a circumferential length which extend from 10%-100% over the circumferentially closed contact surface, and the circumferential length of the micro sealing lips is aligned between plus or minus 75° to plus or minus 135° to the joining direction of the base element and the container whereby the circumferentially closed first contact surface and/or the second contact surface show(s) a micro sealing lip density greater than 10 micro sealing lips per $cm^2$, and the micro sealing lips comprise an E-Module less than 2000 MPa.

2. The bottom dispensing package according to claim 1, characterised in that the relative contact surface between the base element and the container is greater than 10 $mm^2$.

3. The bottom dispensing package according to claim 1, characterised in that the base element is fixed onto the container so that the surface contact pressure between the first contact surface of the base element and the second contact surface of the container is greater than 1 $kp/cm^2$.

4. The bottom dispensing package according to claim 1, characterised in that the base element further comprises a slit-valve, which is especially configurated to prevent the composition to pass the slit-valve as long as container is not squeezed by a user.

5. The bottom dispensing package according to claim 1, characterised in that the container is not sealed by a removable liner element.

6. The bottom dispensing package according to claim 1, characterised in that the base element, including the orifice and the closure, is made from PET, PP or HDPE.

7. The bottom dispensing package according to claim 1, characterised in that the flowable composition has a viscosity between 4 cm to 9 cm on a consistometer.

8. The bottom dispensing package according to claim 1, characterised in that the flowable composition has a ReDox-Potential Eh of +200 to +600 mV at pH7.

9. The bottom dispensing package according to claim 1, characterised in that whereby the dispensing package further comprises at least one tamper evidence indication means for especially visually indicating if the closure has once been moved out of its closed position and whereby the composition may contact a slit-valve of the closure when the closure has not been moved once out of its closed position.

10. The bottom dispensing package according to claim 1, characterised in that the container is made from PET, HDPE, or PP.

* * * * *